United States Patent [19]

Schmid

[11] Patent Number: 4,913,394

[45] Date of Patent: Apr. 3, 1990

[54] ARTICLE HOLDING TRAY ASSEMBLY FOR LADDER

[76] Inventor: Roy Schmid, 170 Autumn Dr., Southington, Conn. 06489

[21] Appl. No.: 252,156

[22] Filed: Oct. 3, 1988

[51] Int. Cl.[4] ..... E06C 7/14

[52] U.S. Cl. ..... 248/238; 182/129; 182/122

[58] Field of Search ..... 248/210, 211, 238, 310, 248/311.2, 313; 182/121, 129, 122

[56] References Cited

U.S. PATENT DOCUMENTS

| | | | |
|---|---|---|---|
| 2,686,032 | 8/1954 | Thorson | 248/211 |
| 2,754,078 | 7/1956 | Koger et al. | 248/311.2 |
| 2,960,601 | 11/1960 | Higgins | 248/311.2 X |
| 3,495,683 | 2/1970 | Broden | 248/210 |
| 3,829,051 | 8/1974 | Emmons | 248/238 |
| 3,940,824 | 3/1976 | Gioia et al. | 248/210 X |
| 3,980,264 | 9/1976 | Tomasik | 248/210 |
| 4,401,187 | 8/1983 | Van Patten | 182/121 |
| 4,445,659 | 5/1984 | LaChance | 248/210 |
| 4,482,030 | 11/1984 | Lincourt | 182/121 |
| 4,489,911 | 12/1984 | Riley | 248/238 |
| 4,523,733 | 6/1985 | Lunden, Jr. | 248/210 |
| 4,660,794 | 4/1987 | Given | 248/238 |
| 4,662,594 | 5/1987 | Dubis | 248/238 |

_FOREIGN PATENT DOCUMENTS

| | | | |
|---|---|---|---|
| 886711 | 7/1953 | Fed. Rep. of Germany | 248/211 |
| 1512155 | 10/1976 | United Kingdom | 182/121 |

*Primary Examiner*—Alvin C. Chin-Shue
*Attorney, Agent, or Firm*—Richard A. Craig

[57] ABSTRACT

An article holding tray assembly is for use on a ladder having elongated side pieces and lower and upper open-ended rungs joining the side pieces. The assembly includes a tray member, a backing member connected to the tray member along a straight line, a lower tubular member parallel to the line and projecting in a predetermined direction from the tray member to a free end, an upper tubular member parallel to the line and projecting in the predetermined direction from the backing member to a free end. The tubular members are adapted for insertion, free ends first, into the lower and upper rungs, with the tray and backing members substantially mutually at right angles. The tray assembly also has a resilient clip member with a body portion capable of flexure and projecting in the predetermined direction from the backing member, a locking portion integral with the body portion and providing a locking surface spaced a predetermined distance from the backing member and facing in the direction opposite the predetermined direction, and a cam portion integral with the locking portion and providing a cam surface integral with the locking surface at its edge remote from the body portion and positioned to be engaged by the rear edge of a ladder side piece, thereby to flex the body portion to permit the locking portion to traverse the rear of the side piece and then snap forward to overlap the same.

15 Claims, 1 Drawing Sheet

ARTICLE HOLDING TRAY ASSEMBLY FOR LADDER

BACKGROUND OF THE INVENTION

This invention relates to article holding tray assemblies for ladders and more particularly to an article holding tray assembly for holding a paint can either to the right or to the left of a hollow rung ladder.

Still more particularly the invention presents an article holding tray assembly which is particularly suitable for holding a one gallon (3.78 l.) paint can adjacent a hollow rung ladder. Moreover, the assembly is of low cost and is of the utmost simplicity, as to structure and manner of use.

In addition, the inventive article holding tray assembly is readily reversible, being capable of assembly with a hollow rung ladder adjacent the right side thereof or the left side thereof, as desired at the moment.

The inventive tray assembly also has a hook member for engagement by the bail of a paint can, to prevent accidental dislodgement of the can from the assembly, and a paint can retainer in the form of a wire member which is releasably engageable with the paint can, also to prevent accidental dislodgement of the can from the assembly. If either the hook member or the retainer is used, such dislodgement cannot occur. The use of both provides double protection.

The foregoing and other objects and advantages will appear hereinafter.

SUMMARY OF THE INVENTION

The inventive article holding tray assembly is for use on a ladder having elongated side pieces and lower and upper open-ended rungs joining the side pieces. The assembly includes a tray member, a backing member connected to the tray member along a straight line, a lower tubular member parallel to the line and projecting in a predetermined direction from the tray member to a free end, an upper tubular member parallel to the line and projecting in the predetermined direction from the backing member to a free end. The tubular members are adapted for insertion, free ends first, into the lower and upper rungs, with the tray and backing members substantially mutually at right angles. The tray assembly also has a resilient clip member with a body portion capable of flexure and projecting in the predetermined direction from the backing member, a locking portion integral with the body portion and providing a locking surface spaced a predetermined distance from the backing member and facing in the direction opposite the predetermined direction, and a cam portion integral with the locking portion and providing a cam surface integral with the locking surface at its edge remote from the body portion and positioned to be engaged by the rear edge of a ladder side piece, thereby to flex the body portion to permit the locking portion to traverse the rear of the side piece and then snap forward to overlap the same.

DESCRIPTION OF THE INVENTION

All views show an article holding tray assembly 10 which is a preferred embodiment of the invention. Assembly 10 is illustrated assembled with a hollow rung ladder 12 having parallel elongated left and right side pieces 14 and 16, respectively, and parallel lower and upper rungs 18 and 20, respectively, perpendicular to and joining side pieces 14 and 16. Rungs 18 and 20 are evenly spaced along side pieces 14 and 16 and are open-ended.

Figure 2:
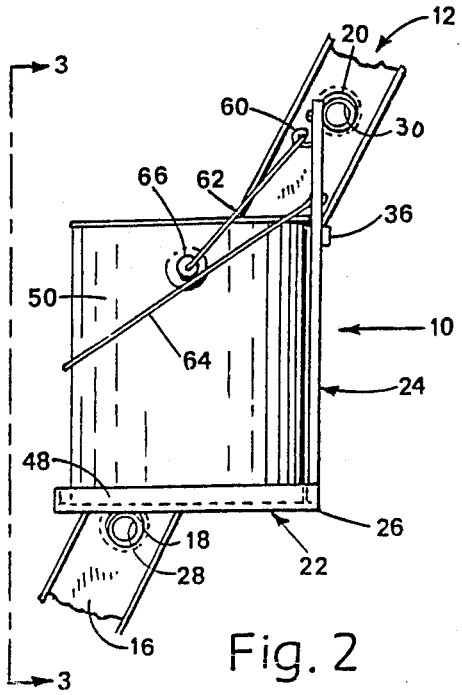
FIG. 2 is a side view showing fragmentarily the ladder of FIG. 1, with the tray assembly holding a gallon paint can.

As is typical of standard ladders, the center-to-center distance between adjacent rungs is constant and is about 12 inches (30.5 cm). As is also typical, when in use, ladders may make an angle of about 65 degrees with the horizontal. Such an angle is illustrated in FIG. 2. This angle may vary slightly, depending on how the ladder is set by the user.

Figure 1:
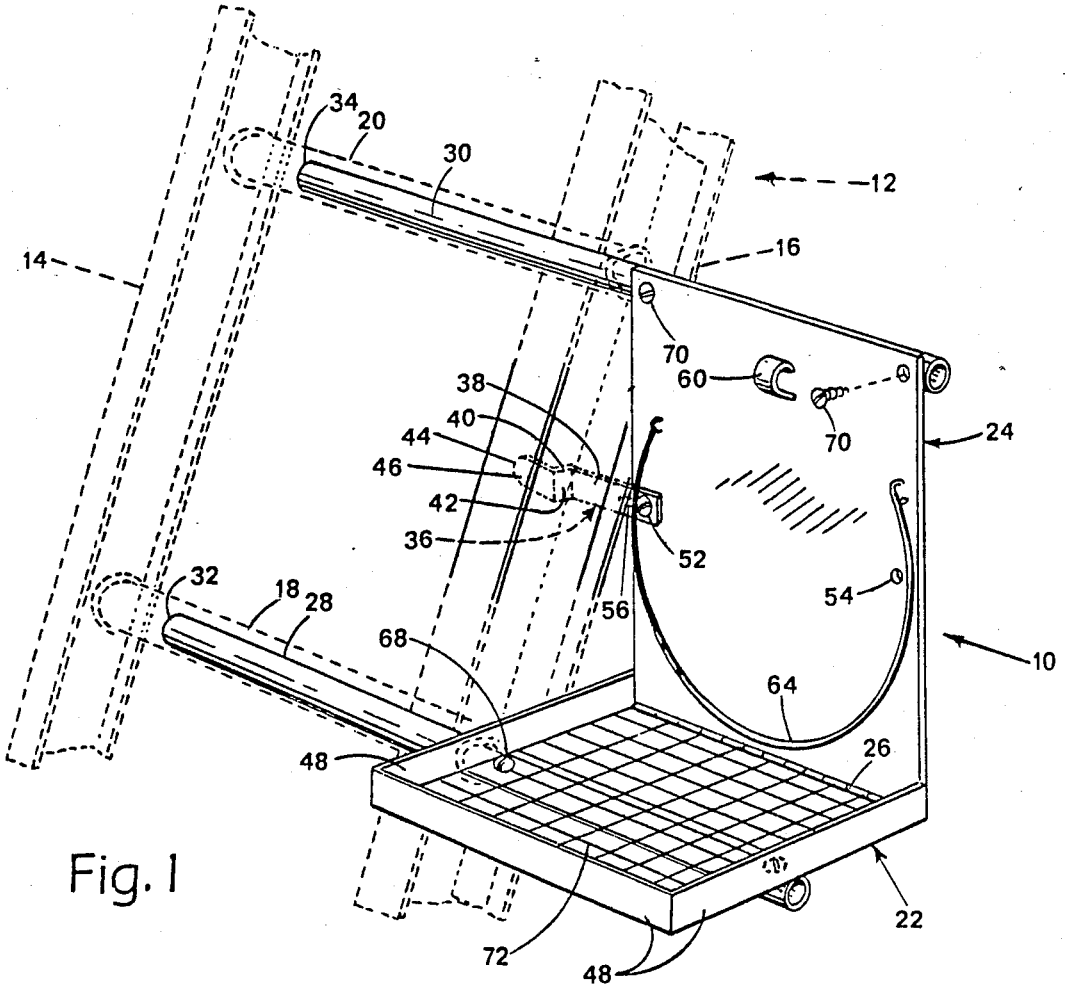
FIG. 1 shows a ladder in fragmentary phantom perspective with a tray assembly embodying the invention assembled with the ladder.

Assembly 10 comprises an article holding or tray member 22 and a backing member 24 connected to tray member 22 along a straight line. As shown in FIG. 1, the straight line is a hinged connection 26, whereby assembly 10 is foldable for ease of shipping and storage.

Lower and upper straight tubular members 28 and 30, respectively, are parallel to hinge 26, each having an outside diameter which is not greater than 0.9375 inch (2.4 cm), to assure easy sliding fit in rungs 18 and 20 of practically all available ladders. Preferably the outside diameter of tubular members 28 and 30 is about 0.875 inch (2.2 cm). Lower member 28 is parallel to line or hinge 26 and is affixed to tray member 22 and projects in a predetermined direction therefrom to a free end 32 (FIG. 1) and upper member 30 is parallel to line or hinge 26 and is affixed to backing member 24 and projects in the predetermined direction therefrom to a free end 34 (FIG. 1).

Members 28 and 30 are adapted for insertion, free ends 32 and 34 first, into lower and upper rungs 18 and 20, with tray member 22 and backing member 24 substantially mutually at right angles.

Figure 3:
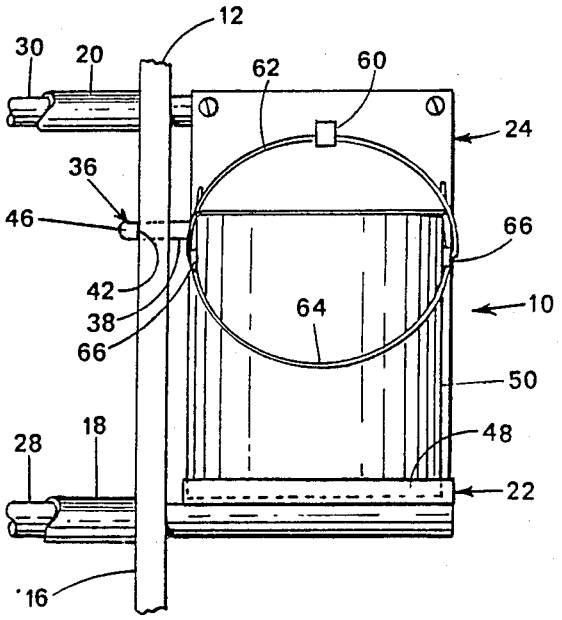
FIG. 3 is a view taken substantially on line 3—3 of FIG. 2.

Article holding tray assembly 10 further comprises a resilient clip member 36 having a body portion 38 capable of flexure and projecting in the same predetermined direction as member 30 from backing member 24 and a locking portion 40 integral with body portion 38 and providing a locking surface 42 (FIGS. 1 and 3) spaced a predetermined distance from backing member 24 and facing in the direction opposite the predetermined direction. Clip member 36 also has a cam portion 44 integral with locking portion 40 and providing a cam surface 46 integral with locking surface 42 at its edge remote from body portion 38 and positioned to be engaged by the rear edge of side piece 16 of ladder 12, thereby to flex body portion 38 to permit locking portion 40 to traverse the rear of side piece 16 and then to snap forward to overlap the same, thus to hold assembly 10 in assembled relationship with ladder 12 adjacent and on the outboard side of right side piece 16.

If it is desired to remove assembly 10 from ladder 12, it is merely necessary to depress cam portion 44 by applying deforming force to cam surface 46 with one's finger and then pull assembly 10 away from ladder 12.

Tray member 22 is as illustrated substantially square and has an upturned peripheral flange 48 around the sides of the square except for the side provided by hinge 26. Lower tubular member 28 is removably affixed to tray member 22 and is re-affixable thereto projecting in the direction opposite the predetermined direction. Likewise, upper tubular member 30 is removably affixed to backing member 24 and is re-affixable thereto projecting in the direction opposite the predetermined direction. Also, clip member 36 is removably affixed to backing member 24 and is re-affixable thereto with body portion 38 projecting in the direction opposite the predetermined direction. In result, assembly 10 is modifiable at the will of the user to be capable of assembly with ladder 12 adjacent and on the outboard side of left side piece 14.

More particularly, the square of article holding member 22 is about 7 inches (17.8 cm) on each side, to accommodate the bottom of a one gallon (3.78 l.) paint can 50 on article holding member 22 within upturned flange 48, the diameter of the bottom of such can 50 being universally about 6.75 inches (17.1 cm).

Backing member 24 is substantially rectangular and has a length perpendicular to hinge 26 which is greater than about 7.25 inches (18.4 cm), which is the universal height of can 50. The width of backing member 24 is about 6.875 inches (17.5 cm). Preferably, the length of backing member 24 is about 11 inches (27.9 cm).

Clip member 36 is located about 5.5 inches (14.0 cm) from hinge 26, and, in the position shown in FIG. 1, locking surface 42 of clip member 36 is located about 1.375 inches (3.5 cm) beyond the adjacent side edge of backing member 24. In this connection, it is noted that clip member 36 is removably secured to backing member 24 by a screw 52 which passes through an elongated hole 56 adjacent the end of body portion 38 and into a hole (not shown) in backing member 24. The hole just mentioned is like a hole 54 in backing member 24 adjacent the opposite side edge of backing member 24. Hole 56 of body portion 38 can be utilized with screw 52 to mount clip member 36 with locking surface 42 at various distances beyond the adjacent side edge of backing member 24, to accommodate ladder side pieces of various widths.

A hook member 60 with an upwardly opening hook is mounted on the centerline of backing member 24 which is perpendicular to hinge 26 and positioned to hold a bail 62 of can 50 with its bottom resting on tray member 24 within flange 48. The use of hook member 60 prevents accidental dislodgement of can 50 from assembly 10.

Tray assembly 10 also comprises a paint can retainer 64 in the form of a wire member pivotally mounted on backing member 24. The ends of retainer 64 are affixed to backing member 24 and retainer 64 is sized and shaped to snap over diametrically opposed ears 66 on can 50 where bail 62 engages can 50. The use of retainer 64 prevents accidental dislodgement of can 50 from assembly 10.

The use of both hook member 60 and retainer 64 provides double protection against accidental dislodgement of can 50 from assembly 10.

Lower tubular member 28 projects about 17 inches (43.2 cm) from tray member 22 and upper tubular member 30 projects about 13 inches (33.0 cm) from backing member 24.

Lower tubular member 28 is removably secured to tray member 22 by two removable screws 68 (only one of which is visible), and upper tubular member 30 is secured to backing member 24 by two removable screws 70. To reverse members 28 and 30 it is merely necessary to remove screws 68 and 70, turn members 28 and 30 end for end and replace screws 68 and 70. The reversal of clip member 36 has already been described.

Tray member 22 has an article holding piece of open mesh material 72 whereas backing member 24 is solid.

It is evident that the invention provides an article holding tray assembly 10 which is particularly suitable for use with one gallon (3.78 l.) paint cans, and that assembly 10 is of the utmost simplicity and low cost, and that its use also is of the utmost simplicity. Further, assembly 10 is readily reversible, so that it is capable of assembly with ladder 12 adjacent the right side thereof or the left side thereof, as desired at the moment.

Slight variations in the angle of set of ladder 12 have been noted above. This does not pose a problem with one gallon (3.78 l.) paint cans 50.

It is evident that the invention attains the stated objects and advantages and others.

The disclosed details are exemplary only and are not to be taken as limitations on the invention except as those details may be included in the appended claims.

What is claimed is:

1. An article holding tray assembly for use on a ladder having parallel elongated left and right side pieces and lower and upper open-ended parallel rungs perpendicular to and joining said side pieces and spaced a predetermined distance from each other, said assembly comprising a tray member, a backing member connected to said tray member along a straight line, a lower tubular member parallel to said line and affixed to said tray member and projecting in a predetermined direction to a free end, an upper tubular member parallel to said line and affixed to said backing member and projecting in said predetermined direction to a free end, said lower and upper tubular members adapted for insertion, said free ends first, into said lower and upper rungs, respectively, with said tray and backing members substantially mutually at right angles, and a resilient clip member having a body portion capable of flexure and projecting in said predetermined direction from said backing member and a locking portion integral with said body portion and providing a locking surface spaced a predetermined distance from said backing member and facing in the direction opposite said predetermined direction, and a cam portion integral with said locking portion and providing a surface integral with said locking surface at its edge remote from said body portion and positioned to be engaged by the rear edge of a side piece of the ladder, thereby to flex said body portion to permit said locking portion to traverse the rear of the last-mentioned side piece and then snap forward to hold said assembly assembled with the ladder adjacent the said overlapped side piece, said tray member and said backing member being joined by a hinge defining said straight line and said tray member having a peripheral upturned flange therearound except along the side provided by said hinge, said lower tubular member being removably affixed to said tray member and re-affixable thereto projecting in the direction opposite said predetermined direction, said upper tubular member being removably affixed to said backing member and re-affixable thereto projecting in the direction opposite said predetermined direction, and said clip member being removably affixed to said backing member and re-affixable thereto with said body portion projecting in the direction opposite said predetermined direction.

2. An assembly according to claim 1 wherein said tray member is substantially square.

3. An assembly according to claim 1 wherein said tray member is adapted to accommodate the bottom of a one gallon (3.78 l.) paint can.

4. An assembly according to claim 3 wherein said backing member is substantially rectangular and has a length perpendicular to said straight line which is greater than about 7.25 inches (18.4 cm) and a width of about 6.875 inches (17.5 cm).

5. An assembly according to claim 4 wherein said clip member is located about 5.5 inches (14.0 cm) from said straight line and said locking surface of said clip member is located about 1.375 inches (3.5 cm) beyond a side edge of said backing member.

6. An assembly according to claim 4 wherein said clip member is located about 5.5 inches (14.0 cm) from said straight line and said locking surface of said clip member is locatable at various distances beyond a side edge of said backing member.

7. An assembly according to claim 4 wherein the dimension of said backing member perpendicular to said straight line is about 11.0 inches (27.9 cm).

8. An assembly according to claim 4 further comprising a hook member mounted on the centerline of said backing member which is perpendicular to said straight line and positioned to hold a bail of a one gallon (3.78 l.) paint can with its bottom resting on said tray member.

9. An assembly according to claim 4 further comprising a paint can retainer in the form of a wire member pivotally mounted on said backing member with the ends of said wire member passing therethrough and sized and shaped to snap over diametrically opposed ears on the paint can where the paint can bail engages the can.

10. An assembly according to claim 4 wherein said lower tubular member projects about 17 inches (43.2 cm) from said tray member and said upper tubular member projects about 13 inches (33.0 cm) from said backing member.

11. An assembly according to claim 8 further comprising a pail retainer in the form of a wire member pivotally mounted on said backing member with the ends of said wire member passing therethrough and sized and shaped to snap over diametrically opposed ears on the paint can where the paint can bail engages the can.

12. An assembly according to claim 1 wherein said lower tubular member is secured to said tray member by removable screws and said upper tubular member is secured to said backing member by removable screws.

13. An assembly according to claim 1 wherein said tray member has an article holding piece of open mesh material.

14. An assembly according to claim 11 wherein said clip member has a clearance hole through said body portion and said clip member is secured to said backing member by a removable screw passing through said clearance hole.

15. An assembly according to claim 11 wherein said clip member has a clearance hole through said body portion, said clearance hole being elongated lengthwise of said body portion and said clip member is secured to said backing member by a removable screw passing through said clearance hole.

* * * * *